US005595243A

United States Patent [19]

Maki, Jr. et al.

[11] Patent Number: 5,595,243

[45] Date of Patent: Jan. 21, 1997

[54] ACOUSTIC WELL CLEANER

[76] Inventors: Voldi E. Maki, Jr., 11904 Bell Ave., Austin, Tex. 78759-2415; Mukul M. Sharma, Dept. of Petroleum Engr. Univ. of Texas, Austin, Tex. 78712

[21] Appl. No.: 544,409

[22] Filed: Oct. 10, 1995

Related U.S. Application Data

[63] Continuation of Ser. No. 283,399, Jul. 29, 1994, abandoned.

[51] Int. Cl.[6] ..... E21B 28/00; E21B 37/08

[52] U.S. Cl. ..... 166/177.2; 166/177.6; 166/311

[58] Field of Search ..... 166/249, 311, 166/177.1, 177.2, 177.7, 177.6

[56] References Cited

U.S. PATENT DOCUMENTS

| | | | |
|---|---|---|---|
| 3,378,075 | 4/1968 | Bodine | 166/177 |
| 3,478,883 | 11/1969 | Deluca | 210/108 |
| 3,527,300 | 9/1970 | Phillips | 166/249 |
| 3,648,769 | 3/1972 | Sawyer | 166/177 |
| 3,721,297 | 3/1973 | Challacome | 166/299 |
| 4,280,557 | 7/1981 | Bodine | 166/177 |
| 4,280,558 | 7/1981 | Bodine | 166/245 |
| 4,343,356 | 8/1982 | Riggs et al. | 166/60 |
| 4,437,518 | 3/1984 | Williams | 166/248 |
| 4,537,256 | 8/1985 | Beard | 166/177 X |
| 4,538,682 | 9/1985 | McManus et al. | 166/255 |
| 4,658,897 | 4/1987 | Kompanek et al. | 166/249 |
| 4,788,467 | 11/1988 | Plambeck | 166/249 X |
| 5,109,922 | 5/1992 | Joseph | 166/65.1 |
| 5,184,678 | 2/1993 | Pechkov et al. | 166/249 |

OTHER PUBLICATIONS

M. Ward Widener, "The Development of high efficiency narrow band transducers and arrays", Journal of the Acoustical Soc. of Am. vol. 67 (3) pp. 1051–1057 Mar. 1980.

M. Ward Widener, "The Development of Deep Submergence, air backed transducer", JASA vol. 80 (6) Dec. 1986 pp. 1852–1853.

*Primary Examiner*—Hoang C. Dang

*Attorney, Agent, or Firm*—Andrew J. Dillon

[57] ABSTRACT

A method and apparatus are disclosed for cleaning the wellbore and the near wellbore region. A sonde is provided which is adapted to be lowered into a borehole and which includes a plurality of acoustic transducers arranged around the sonde. Electrical power provided by a cable is converted to acoustic energy. The high intensity acoustic energy directed to the borehole wall and into the near wellbore region, redissolves or resuspends the material which is reducing the permeability of the formation and/or restricting flow in the wellbore.

3 Claims, 5 Drawing Sheets

ACOUSTIC WELL CLEANER

The United States Government has a paid-up license in this invention and the right in limited circumstances to require the patent owner to license others on reasonable terms as provided for by the terms of Contract No. 9-XQ2-Y1169-1, awarded by the Department of Energy.

This is a continuation of U.S. patent application Ser. No. 08/283,399, filed Jul. 29, 1994, now abandoned.

BACKGROUND—FIELD OF INVENTION

This invention relates to downhole acoustic sources, specifically to such acoustic sources which can be used for cleaning oil, gas, and water wells, wellbores, perforations, and near wellbore formation damage.

BACKGROUND—DESCRIPTION OF PRIOR ART

The productivity of oil and gas wells declines with time to various reasons. Some of these reasons are: plugging of pores in the rock by mineral "fines" that flow with the produced fluids, precipitation of inorganic scales, paraffin and asphaltene deposition, clay swelling, invasion of mud solids and mud filtrate, invasion of completion fluids, and solids from injected brines. Each of the above reasons can cause a decline in the permeability of the region around the wellbore or a restriction to flow in the wellbore itself.

Periodic stimulation of oil and gas wells is routinely conducted using three general types of treatments: acidizing, fracturing and solvent/heat treatments. Acidizing involves the use of mixtures of hydrochloric (HCL) and hydrofluoric acid (HF) that are injected into the producing payzone (rock). The acid is designed to dissolve the reactive components of the rock (carbonate and clay minerals and to a lesser extent silica) and increase its permeability. Additives such as corrosion inhibitors and solvents are often added to enhance the performance of the acid job. While acidizing is a common treatment for stimulating oil and gas wells it has some clear drawbacks. It is expensive because of the chemical costs and waste disposal costs involved. Acids are often incompatible with the crude oil and can result in thick oily sludges downhole. Precipitates formed after the acid is spent can often be more damaging than the minerals dissolved. The depth of penetration of the live acid is usually less than 3" to 5".

Hydraulic fracturing is another technique that is commonly used to stimulate oil and gas wells. In this process large hydraulic pressures are used to create vertical fractures in oil and gas bearing rock. The fractures can be packed with proppant (in sandstones) or etched with acid (in carbonates and other soft rock) to create a conduit for oil and gas to flow into the wellbore. This process is extremely expensive (about a factor of five to ten more than an acid job). In some cases the fracture can extend into water bearing zones increasing the amount of water being produced (undesirable). Such treatments extend several hundred feet away from the wellbore and are more commonly used in low permeability rocks. The ability to place proppant successfully in the entire fracture is usually limited and problems such as fracture closure and proppant crushing can severely impair the productivity of hydraulic fractures.

One of the most common problems in mature oil wells is the precipitation of paraffins and asphaltenes in and around the wellbore. Steam or hot oil is injected into the wellbore to melt the paraffins redissolve them in the oil and flow them to the surface. Organic solvents (such as xylene) are often used to remove asphaltenes that have a high melting point and are insoluble in alkanes. Steam or solvent soaks both expensive (solvents more so than steam) particularly when treating marginal wells producing less than 10 bbls of oil per day. It should be noted that there are over 100,000 such wells in Texas alone.

A major limitation in steam or solvent soaks is the lack of mechanical agitation that is required to redissolve or resuspend the paraffins and asphaltenes.

Downhole tools that create pressure pulses and can be used for cleaning have been proposed earlier. For example in U.S. Pat. No. 3,721,297, to R. D. Challacombe, a series of explosive caps and gas producing modules are interconnected on a single string so that burning one ignites the others in succession. The explosions create shock waves that were claimed to clean wells. This method has distinct disadvantages, i.e. the potential hazards of damaging high pressure oil and gas wells with explosives. In addition the risk of fire and lack of control on treatment time make this an impractical method.

U.S. Pat. No. 3,648,769 to Mr. H. T. Sawyer describes a hydraulically driven diaphragm that creates "sinusoidal vibrations in the low sonic range." The waves generated are low intensity and are not directed or focused at the face of the rock. As a result much of the energy propagates along the borehole.

U.S. Pat. No. 4,343,356 to E. D. Riggs et al. describes an apparatus for treating subsurface boreholes. Application of a high voltage results in the generation of a voltage arc which dislodges scale material from the walls of the borehole. This is an entirely different method for cleaning than is proposed here. It is not clear if this arcing can be conducted continuously as the sonde is pulled out of the hole or if any cleaning is affected. Safety (electrical and fire) remains a major concern.

Another hydraulic/mechanical oscillator was proposed by A. G. Bodine (U.S. Pat. No. 4,280,557). Hydraulic pressure pulses created inside an elongated elastic tube is used to clean the walls of the casing in wells. This also suffers from being low intensity and poorly directed.

Finally a method for removing paraffin from oil wells was proposed by J. W. Manus (U.S. Pat. No. 4,538,682). The method is based on establishing a temperature gradient in the well by introducing a heating element in the well.

None of the patents listed above propose any device or are based on any principle used in the present invention.

OBJECTS AND ADVANTAGES

Several objects and advantages of the present invention are:

a) To provide a downhole acoustic source that generates extremely high energy acoustic waves that are capable of removing "fines", scales and organic deposits both in and around the wellbore.

b) To provide a downhole acoustic source that does not require the injection of any chemicals to stimulate oil and gas wells.

c) To provide a downhole acoustic source that does not have any environmental treating costs associated with fluids flowing back from the well after treatment.

d) To provide a downhole acoustic source that can be run through 1 11/16" tubing without having to pull the tubing.

e) To provide a downhole acoustic source that can be run in any type of completion hole, cased/perforated hole, gravel packed, screens/liners, etc.

f) To provide a downhole acoustic source that can be run in conjunction with other chemical stimulation treatments such as solvent soaks, acidizing, etc.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

Figure 1:
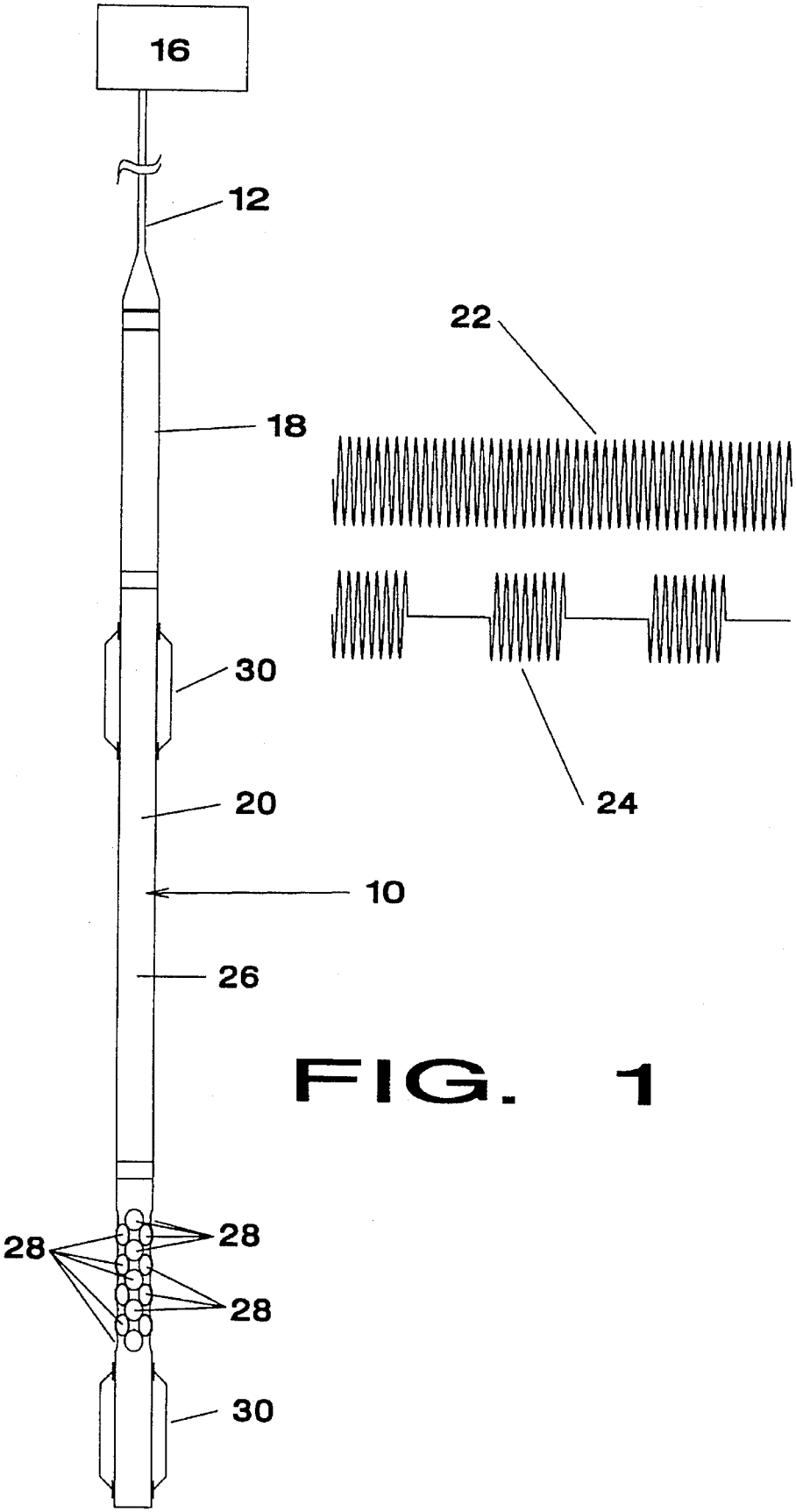
FIG. 1. a drawing showing the functional elements in the tool.

REFERENCE NUMERALS IN DRAWINGS 10 86 mm Diameter tool
12 wireline cable
16 up hole power supply
18 down hole power supply
20 logic circuit
22 continuous sine wave
24 burst waveform
26 power amplifier
28 transducer
30 centralizers
32 vertical axis on graph
34 Borehole diameter axis
36 power for 86 mm diameter tool
38 power for 64 mm diameter tool
40 power for 43 mm diameter tool
42 shaded portion of graph
44 ceramic element
46 ceramic element
48 head mass
50 face of head mass
52 "O" ring seal groove
54 bolt
56 positive electrode of ceramic
58 ground electrode
60 center electrode
62 insulator
64 washer
66 flat washer
68 tension member
70 compression member
72 space behind transducer
74 cased hole
76 perforation
78 producing zone
80 43 mm diameter tool
82 sand screen
84 production tubing

DETAILED DESCRIPTION OF THE PREFERRED EMBODIMENT

The functional elements of the tool are shown in FIG. 1. A tool 10 is lowered into a well via a wireline cable 12. Power is supplied to electronics via this cable from a power supply located uphole 16. An electronics package performs several functions. A power supply 18 provides regulated voltages to the various functional units. A logic circuit 20 controls a transmit frequency and a modulation signal applied to transducers. Transducers 28 may be driven with a continuous sine wave 22 or may be pulsed on and off rapidly 24. The modulation of the signal allows for a pulse power greater than the average power. A logic circuit 20 creates the proper signal with which to drive power amplifiers 26. Power amplifiers convert the power supplied by a cable to a high frequency signal 20 kHz to 100 kHz which drives the acoustic transducers 28. The tool may have from 1 to 36 individual transducers depending upon the power capability of the cable and the size of the tool. Centralizers 30 are used to maintain the tool in the center of the borehole or tubing.

Figure 2:
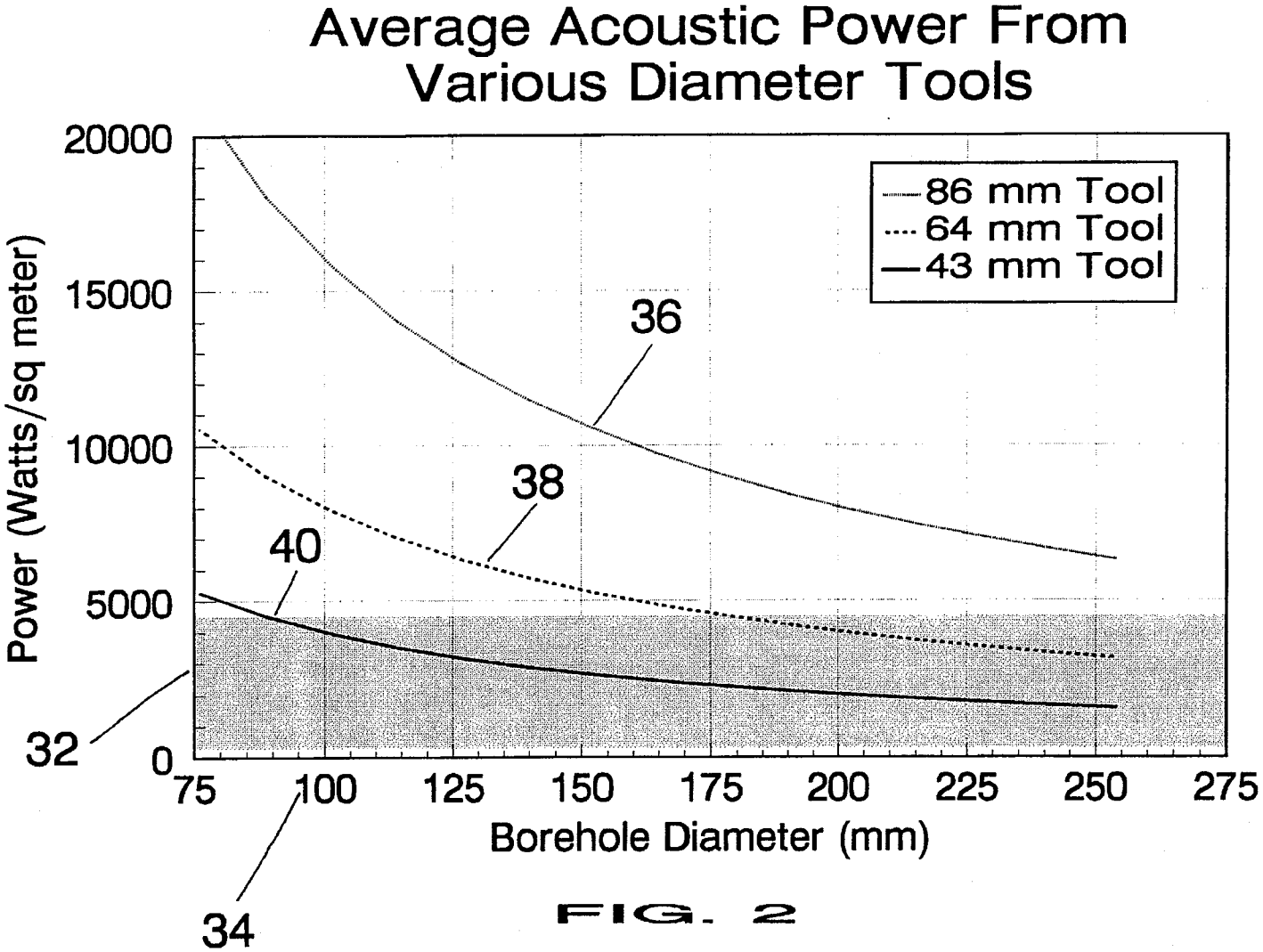
FIG. 2. a graph showing the sound intensity produced by various diameter tools on the surface of the borehole as a function of borehole diameter.

Since the tool is designed to use multiple small transducers, it is possible to easily configure the basic design into tools having various diameters. Increasing the diameter of the tool allows placing more transducers around the circumference of the tool. FIG. 2 shows the acoustic intensities produced by various diameter tools used in various diameter wells. The vertical axis 32 is the acoustic intensity in watts per square meter. The horizontal axis 34 is the borehole diameter. The three curves 36, 38, 40, are the intensities created by three tool sizes. The limit on acoustic intensity is based upon the mechanical configuration of the transducers in the tool body and the level of power which may be delivered down the particular wireline cable used. The shaded portion of the graph 42 shows the intensity levels at which significant cleaning has been obtained in experimental work. This graph shows that even the smallest tool provides power levels adequate to clean a 203 mm diameter borehole.

Figure 3:
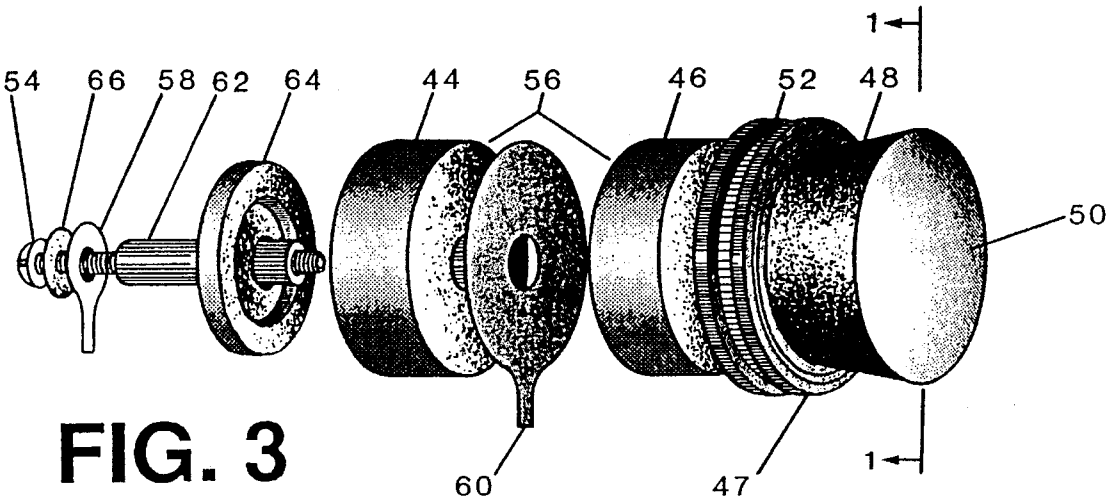
FIG. 3. a drawing showing the preferred embodiment of the transducer.
Figure 4:
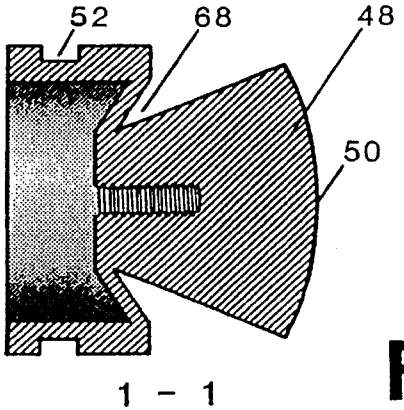
FIG. 4. a drawing showing one embodiment of the head mass.
Figure 5:
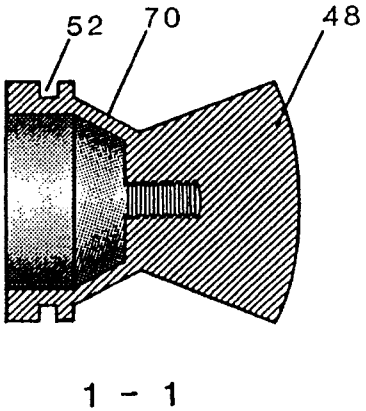
FIG. 5. a drawing showing a second embodiment of the head mass.

A thorough discussion of the design of this type of transducer has been published by M. Ward Widener, "The Development of high efficiency narrow-band transducers and arrays", Journal of the Acoustical Society of America Vol. 67, Mar. 3, 1980, pg. 1051–1057. Another related article by the same author, "The development of a deep submergence, air-backed transducer", J. Acoust. Soc. Am. 80, Dec. 6, 1986, pg. 1852–1853 further describes the construction process for the type transducer used in this tool. A preferred design of the transducer is shown in FIG. 3. Ceramic elements 44 and 46 form half of the Tonpilz resonator, a metal head mass 48 forms the other half. The face 50 of the head mass 48 is machined slightly convex so as to produce a constant sound pressure level across the surface. Included in the horn is an "O" ring seal groove 52 which may be utilized with an "O" ring to sew the ceramic from the borehole fluid. A bolt 54 is used to clamp the assembly together. By assembling the two ceramic elements with the+electrodes 56 in the center, the head mass and the bolt may be held at ground potential. A ground electrode 58 is connected at the head of a bolt. This makes it convenient for the tool to also be at ground potential. The power amplifier is connected to a center electrode 60. An insulator 62 is required on the shaft of the bolt. This insulates the bolt from the center of the two ceramic elements. A washer 64 is machined so as to distribute the pressure of the bolt evenly across the surface of the ceramic. It is also well known in the art that this washer may be much greater in mass. A second flat washer 66 is used to protect the ground electrode. The mass cone and support and fluid seal may be made from a single piece of material. FIG. 4 shows the support having a tension member 68. In like manner, FIG. 5, the support may also be designed to utilize a compression member 70 to support the hydrostatic load. The method of support has little effect on the performance so long as it is affixed at the node of the resonance. The individual transducers are complete functioning parts, they may be individually tested outside of the tool or replaced when necessary. One transducer design may be used in many different size tools.

Figures 6A, 6B, 6C:
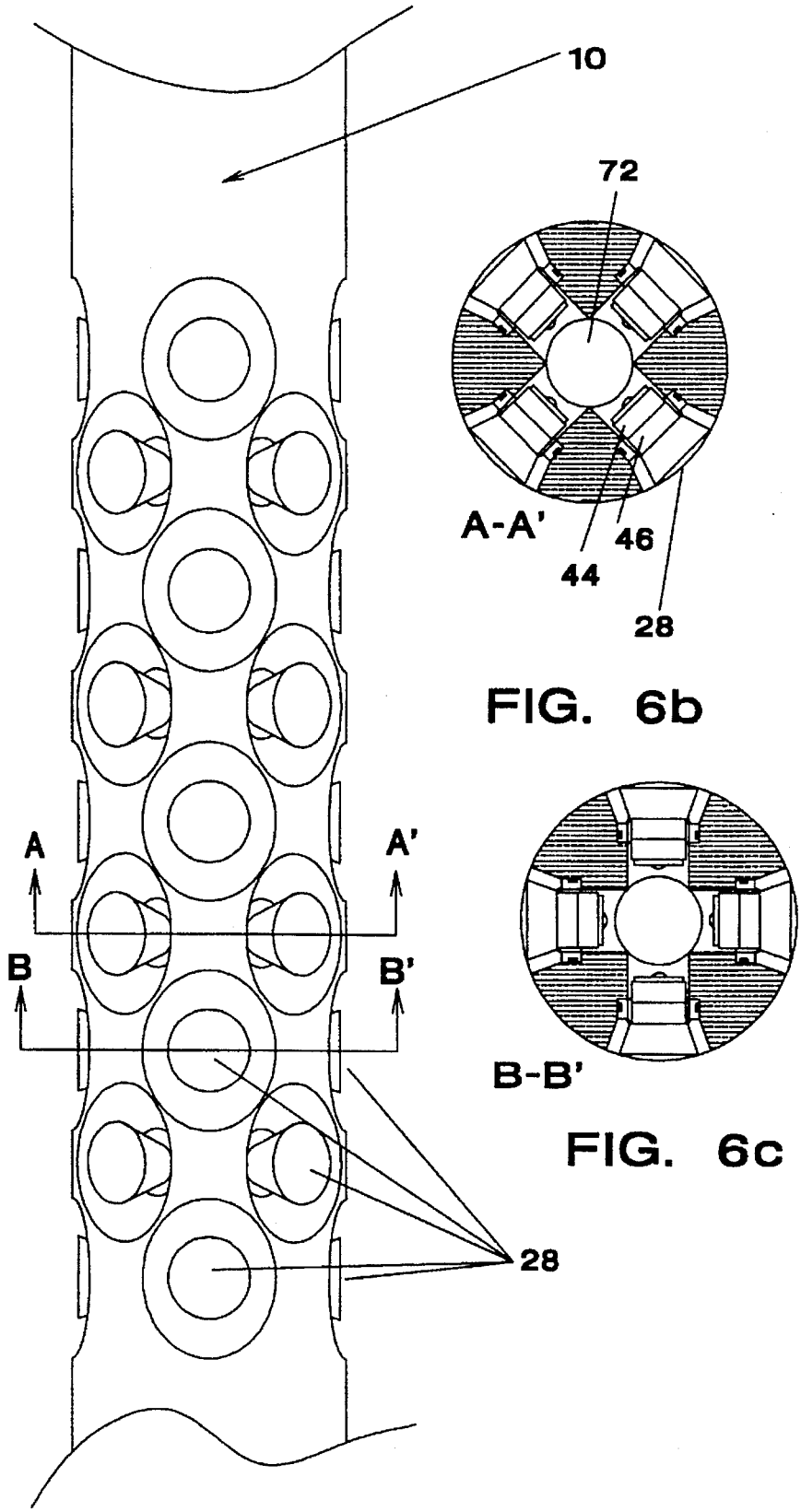
FIG. 6*a*. is a drawing of one configuration of the transducer array.
FIG. 6*b*. is a sectional view of the configuration of the transducer array of FIG. 6*a*, taken along line A—A'.
FIG. 6*c* is a sectional view of the configuration of the transducer array of FIG. 6*a* taken along B—B'.

FIG. 6*a* shows the method for mounting the transducer in an 86 mm diameter tool 10. A ring of 4 transducers 28 is located at each level in the tool. This drawing shows 9 rings of transducers with each ring rotated by 45 degrees from its most adjacent ring. FIG. 6*b* shows a cross section of one ring of transducers. A space 72 behind the transducers contains air at atmospheric pressure and allows for electrical connections to be made to the ceramic elements 44 and 46. FIG. 6*c* shows an adjacent ring to the one shown in FIG. 6*b*. This ring is rotated 45 degrees from the adjacent ring. This arrangement of the transducers maximizes the density of the transducers in the tool thereby maximizing the acoustic intensity at the location of the transducers.

OPERATION

Figure 7:
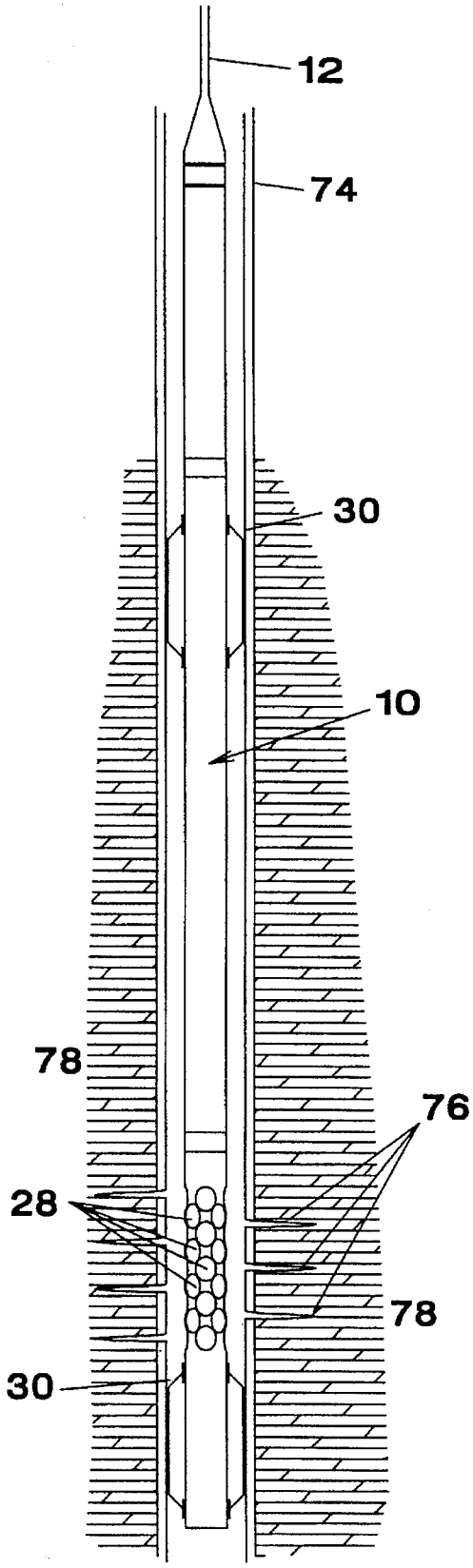
FIG. 7. is a pictorial representation of the acoustic cleaner of the present invention used to clean a cased or open borehole.

The tool is used as if it were a standard wireline tool FIG. 7. The tool is maintained in the central portion of the well using two centralizers 30. This tool 10, utilizes 36 transducers 28. It is lowered into the well using a wireline truck and cable. Once it is at the proper depth, power is supplied to the tool and it is pulled upward through the producing zone. FIG. 7 shows 86 mm diameter tool used in a cased hole 74 having perforations 76 in a producing zone 78. The tool may be pulled past the perforations slowly several times or left at a specific depth for a short period of time and then moved upward in short steps. This is a much simpler and cheaper operation that the previously used treatment techniques.

Figure 8:
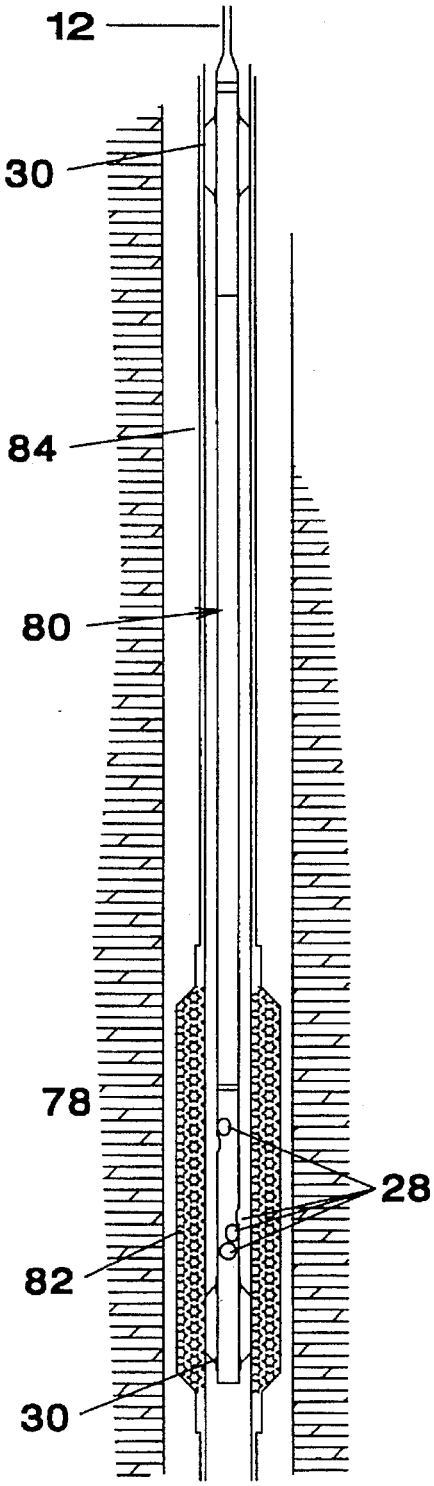
FIG. 8. is a pictorial representation of the acoustic cleaner in a different configuration used to clean a sand screen in a well with production tubing installed.

FIG. 8 shows a 43 mm diameter tool 80 used when production tubing is in the well. The operation of the tool is the same as for the large diameter tool. In the typical application, a sand screen 82 used in the tubing becomes clogged with fines or with paraffin. The array of 8 transducer elements 28 is arranged in a helix around the tool. The centralizers 30 maintain the tool near the center of the production tubing 84. The great advantage of this tool is that the production tubing need not be pulled to treat the sand screen 82.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An apparatus for producing high acoustic levels in a well for the purpose of stimulating fluid production from a formation into a well, said apparatus comprising:

an elongate sealed tool housing;

a plurality of acoustic transducers circumferentially mounted within said elongate sealed tool housing, each of said acoustic transducers comprising:

a piezoelectric ceramic source within an air chamber isolated from the well fluid;

a head mass coupled to the ceramic source and exposed to the well fluid; and a support which isolates the well fluid from the air chamber located at the node of the resident structure formed by the ceramic source and the head mass; and wherein said acoustic transducers are radially oriented in order to direct high energy acoustic radiation directly into the formation.

2. The apparatus for producing high acoustic levels in a well for purposes of stimulating fluid production from a formation into the well according to claim 1, wherein said plurality of acoustic transducers circumferentially mounted in said elongate sealed tool housing further comprise a plurality of adjacent rings of four transducers, each ring of four transducers rotated by 45° from an adjacent ring.

3. The apparatus for producing high acoustic levels in a well for purposes of stimulating fluid production from a formation into the well according to claim 1, wherein said plurality of acoustic transducers circumferentially mounted in said elongate sealed tool housing further comprise a helical array of acoustic transducers circumferentially mounted in said elongate sealed tool housing.

* * * * *